US006141424A

United States Patent [19]

Takiguchi et al.

[11] Patent Number: 6,141,424

[45] Date of Patent: Oct. 31, 2000

[54] HEADPHONE CAPABLE OF DIRECTLY CONVERTING DIGITAL AUDIO SIGNAL INTO ANALOG AUDIO SIGNAL

[75] Inventors: Iwao Takiguchi; Motoyuki Yoshizumi, both of Kanagawa, Japan

[73] Assignee: Sony Corporation, Tokyo, Japan

[21] Appl. No.: 09/219,838

[22] Filed: Dec. 23, 1998

[30] Foreign Application Priority Data

Dec. 24, 1997 [JP] Japan ..... 9-354600

[51] Int. Cl.[7] ..... H04R 1/10

[52] U.S. Cl. ..... 381/74; 381/2; 381/370

[58] Field of Search ..... 381/74, 300, 309, 381/311, 182, 370, 386, 2

[56] References Cited

U.S. PATENT DOCUMENTS 5,640,458 6/1997 Nishiguchi ..... 381/74

FOREIGN PATENT DOCUMENTS 406178396 6/1994 Japan ..... 381/74

2279195 12/1994 United Kingdom ..... 381/74

*Primary Examiner*—Minsun Oh Harvey

*Attorney, Agent, or Firm*—Jay H. Maioli

[57] ABSTRACT

A headphone containing right/left-channel acoustic units capable of converting an analog audio signal into acoustic sounds. An input jack to which is supplied a digital audio signal derived from a digital audio appliance is provided within the headphone. A D/A converter for D/A-converting the digital audio signal supplied to the input jack into an analog audio signal, and an amplifier for amplifying the analog audio signal derived from the D/A converter to supply the amplified analog audio signal to the right/left-channel acoustic units, are provided in this headphone.

4 Claims, 4 Drawing Sheets

HEADPHONE CAPABLE OF DIRECTLY CONVERTING DIGITAL AUDIO SIGNAL INTO ANALOG AUDIO SIGNAL

BACKGROUND OF THE INVENTION

The present invention generally relates to a headphone. More specifically, the present invention is directed to a headphone capable of directly converting a digital audio signal into an analog audio signal within this headphone.

In portable type audio appliances, for example, portable CD (compact disc) players, headphones are used. Also, generally speaking, in deck type audio appliances, headphones are available.

However, output impedances of headphone jacks (namely headphone terminals) of these audio appliances are different from each other, depending upon the audio appliance. That is, drive impedances have different values while being viewed from these headphones. As a result, even when the same headphone is used, optimum damping effects may not be achieved, depending upon such conditions that the same headphone is connected to different audio appliances, or the model sorts of the audio appliances are different from each other.

Furthermore, sound qualities of headphones are varied, depending on analog circuits of audio appliances connected to these conventional headphones.

As previously described, the sound qualities of the conventional headphones would be highly influenced by the audio appliances connected to these headphones. As a consequence, even when the sound qualities of these headphones are improved, there are many difficulties in that the optimally-designed sound qualities could not be provided to users. In other words, users could not have the sound qualities of these headphones expected by headphone manufactures.

SUMMARY OF THE INVENTION

The present invention has been made to solve these problems of the conventional headphones, and therefore, has an object to provide a headphone capable of achieving an optimally-designed sound quality.

A headphone, according to an aspect of the present invention, is featured by comprising:

an acoustic unit for converting an analog audio signal into an acoustic sound;

a connector unit to which a digital audio signal derived from a digital audio appliance is supplied;

a D/A (digital-to-analog) converter for D/A-converting the digital audio signal supplied to the connector unit into an analog audio signal; and an amplifier for amplifying the analog audio signal derived from the D/A converter to supply the amplified analog audio signal to the acoustic unit, in which:

the acoustic unit, the connector unit, the D/A converter, and the amplifier are built in the headphone.

As a consequence, the digital audio signal derived from the digital audio appliance is directly supplied to the headphone and is converted into the analog audio signal within the headphone. Then, this analog audio signal is reproduced as the acoustic sounds.

BRIEF DESCRIPTION OF THE DRAWINGS

A more complete understanding of the teachings of the present invention may be acquired by referring to the accompanying figures, in which like reference numbers indicate like features and wherein.

DETAILED DESCRIPTION OF THE PREFERRED EMBODIMENTS

Referring now to drawings, various preferred embodiments of the present invention will be described in detail.

Before describing headphones of the present invention, the digital I/O (input/output) format used in digital audio appliances will now be explained. Most digital audio appliances commercially available are equipped with digital output jacks through which digital audio signals may be outputted. As the output formats of these digital audio signals, the digital I/O format standardized by EIAJ (Electronic Industries Association of JAPAN) is used.

Figure 1:
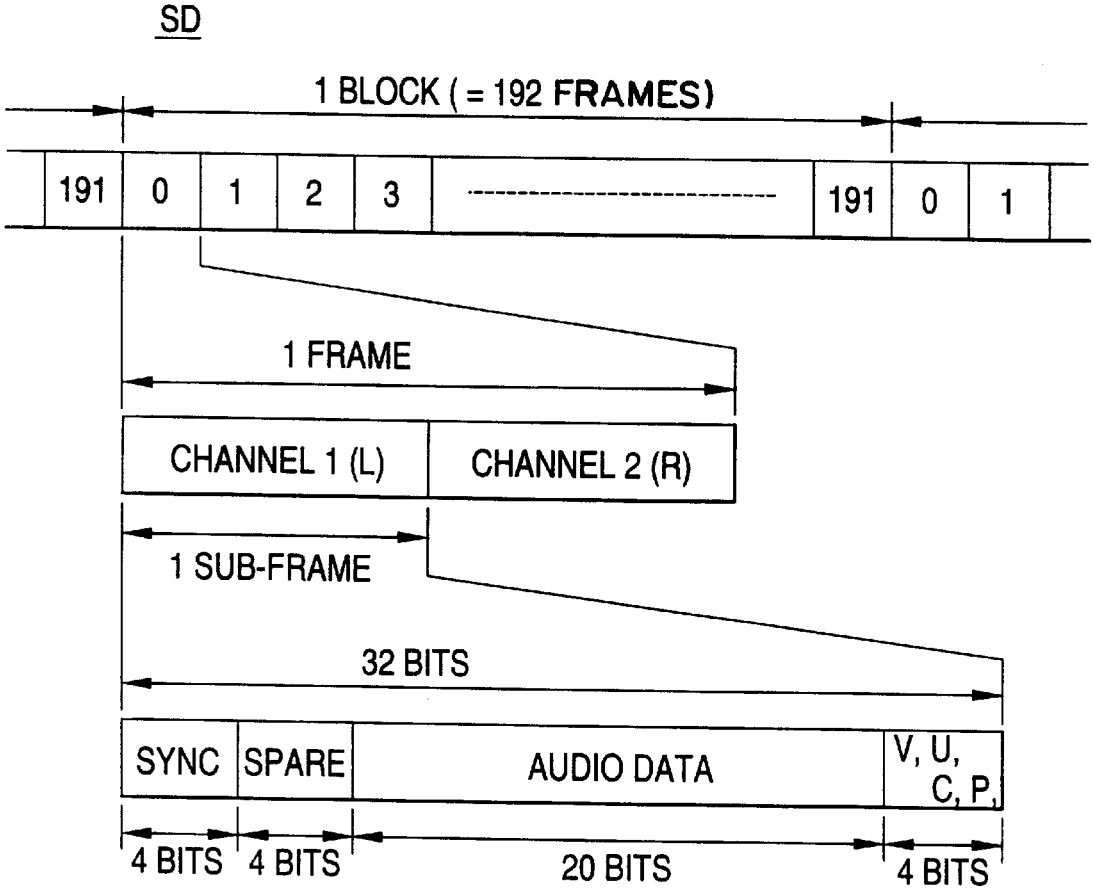
FIG. 1 represents the digital I/O format ruled by Electronic Industries Association of Japan (EIAJ)

FIG. 1 illustratively shows this digital I/O format standardized by EIAJ. As indicated in this digital I/O format, a digital audio signal SD is equal to a serial signal constructed of a plurality of continued blocks, a single block is constituted by 192 frames, and a single frame among these 192 frames is arranged by two sets of subframes. In this case, one subframe contains digital audio data for one sample. In a 2-channel stereophonic system, a front subframe and an end subframe within one frame are allocated to left-channel audio data and right-channel audio data, respectively.

Then, a single subframe is dimensioned by 32 bits. Among 32-bit data, 4-bit head data is used as a bit sync signal having another function capable of discriminating a subframe, and 4-bit data subsequent to this 4-bit head data is used as a spare bit. Furthermore, 20-bit data subsequent to this spare bit is digital audio data representative of an actual one sample. At this time, audio data "DATA" corresponds to a digital signal produced by such that an original analog audio signal is linear-quantized by way of a complement indication of 2. As a consequence, the digital audio signal SD can be transferred until one sample becomes 20-bit digital audio data. However, when one sample becomes 24-bit digital audio data, the spare bit is also used to transfer this 24-bit digital audio data.

Furthermore, final 4 bits V, U, C and P of the subframe are used as control signals. Then, the head bit "V" is equal to a validity flag. When the validity flag V=0, the digital audio data contains no error, and becomes valid. Conversely, when the validity flag V=1, the digital audio data contains an error, and becomes invalid. Also, the succeeding bit "U" is equal to an undefined user bit. The bit "C" is equal to a channel status. These data for one block (192 frame) are collected so as to handle various sorts of information and various controls. The last bit "P" corresponds to a parity bit every subframe.

Then, this digital audio signal SD is converted into a biphase mark signal, and this biphase mark signal is transferred in the form of either an electric signal or an optical signal. It should be noted that this digital I/O format similarly standardizes the characteristics while the digital audio signal SD is transferred in the form of the optical signal, and furthermore similarly standardizes the optical connector used when this optical signal is transferred.

As previously explained, since the digital audio signal SD has been formatted, the various sorts of circuits capable of processing this formatted digital audio signal SD are manufactured by a single-chip IC (integrated circuit).

On the other hand, other various sorts of circuits such as D/A converters used in digital audio appliances may be manufactured in the form of a single-chip IC. The power consumption of this single-chip IC is sufficiently low and therefore is operable by way of a cell.

The present invention has been made by considering the above-described technical aspects, and a headphone of the present invention is featured in that a D/A converter, an output amplifier, and other electronic circuits are built in this headphone, and then a digital audio signal reproduced from a CD player is directly inputted into this headphone.

Figure 2:
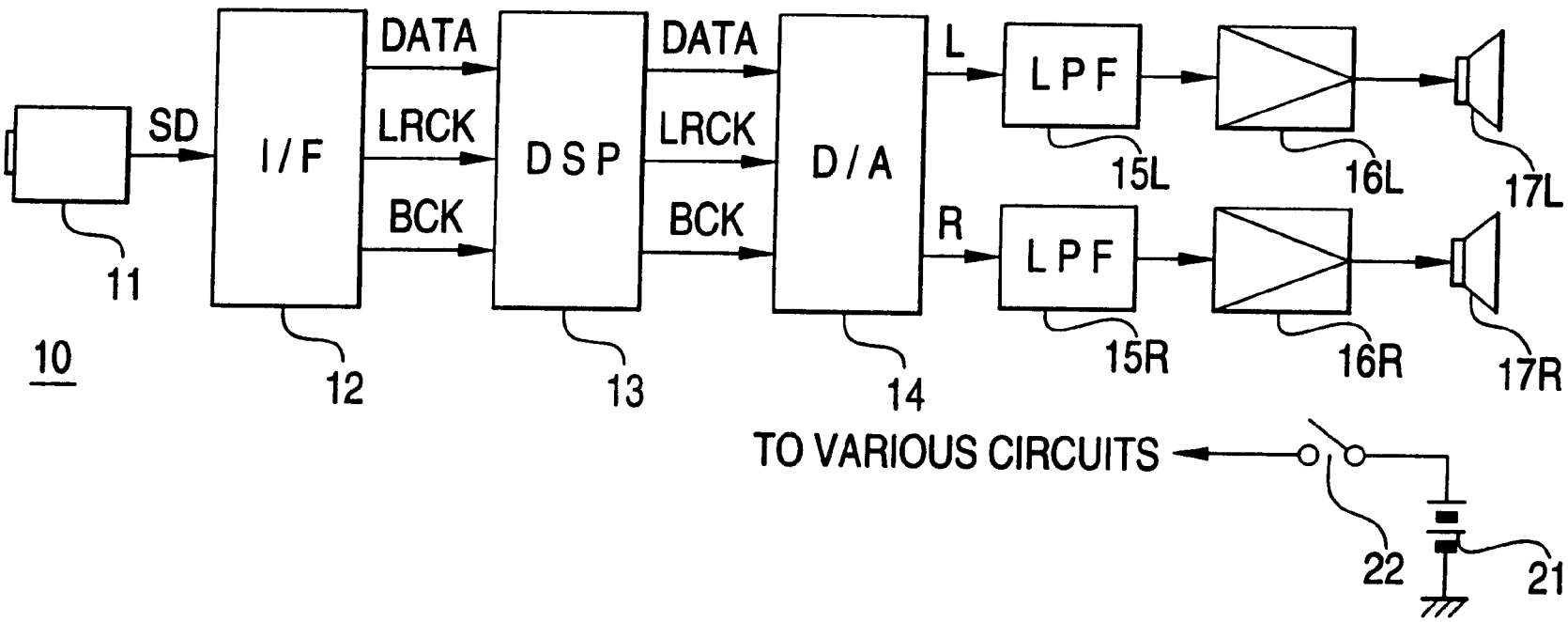
FIG. 2 is a schematic block diagram for showing an internal circuit of a headphone according to an embodiment of the present invention.
Figure 3:
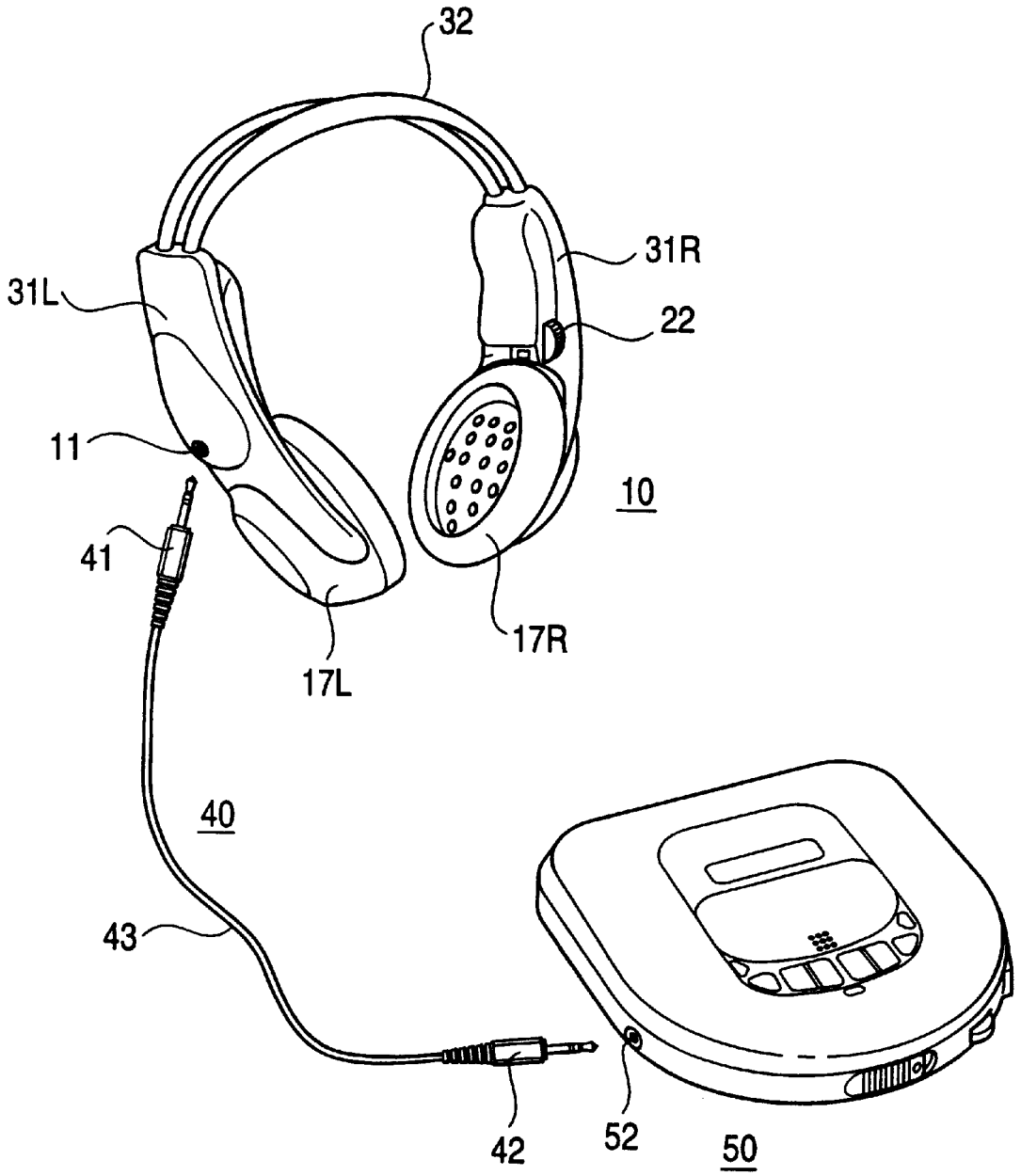
FIG. 3 is a perspective view for indicating the headphone of FIG. 2 and a CD player connectable to this headphone.

Referring now to FIG. 2 and FIG. 3, a headphone according to an embodiment of the present invention will be described in detail.

In a circuit block diagram of FIG. 2, reference numeral 10 indicates a headphone according to this embodiment of the present invention. This headphone 10 is equipped with a connector, namely a jack 11. To this jack 11, a digital audio signal SD having the digital I/O format as previously explained in FIG. 1 is supplied from a digital audio appliance (not shown). This digital audio signal SD is further supplied to a digital audio interface 12.

The digital audio interface 12 separates digital audio data "DATA" from the digital audio signal SD supplied to this digital audio interface 12, and then outputs the separated digital audio data DATA, and further a flag "LRCK" and also a bit clock "BCK" of the outputted digital audio data DATA. This flag LRCK indicates that this outputted digital audio data DATA corresponds to either a left-channel signal or a right-channel signal.

Then, the digital audio data DATA, the flag LRCK, and the bit clock BCK are supplied from this digital audio interface 12 to a DSP (digital signal processor) 13. This DSP 13 performs various sorts of acoustic process operations with respect to this digital audio data DATA supplied thereto, for instance, a noise canceling process, a surrounding process, an external-ear process for localizing a sound image outside a head of an audience, a low-frequency sound enhancement process, and an equalizing process of a frequency characteristic.

Thereafter, the digital audio data DATA, the flag LRCK, and the bit clock BCK, which are processed and derived from this DSP 13 are supplied to a D/A converter 14, so that this digital audio data DATA is D/A-converted into a left-channel analog signal "L" and a right-channel analog signal "R". These right/left-channel signals R/L are filtered by low-pass filters 15R and 15L. Then, the filtered right/left-channel signals R/L are amplified by right/left-channel amplifies 16R/16L. The amplifiers right/left-channel signals are supplied to right/left-channel acoustic units (namely, electric/acoustic converting drives) 17R/17L so as to be converted into right/left-channel acoustic output signals. It should be noted that although not shown in the drawing, a variable resistor is employed in each of these amplifiers 16R/16L in order to control a sound volume.

As a power source, for example, two sets of cells 21 (cell size of "UNIT 3") are series-connected to each other. A DC output voltage of the series-connected cells is applied via a power supply switch 22 to various electronic circuits. It should be understood that the above-described digital audio interface 12, DSP 13, D/A converter 14 filters 15R and 15L, and right/left-channel amplifiers 16R/16L are manufactured as a single-chip IC.

FIG. 3 shows an outer view of the above-described headphone 10 according to this embodiment. In this drawing, upper end portions of right/left housing units 31R/31L are coupled with each other by using a coupling member, namely a head band 32. The right/left-channel acoustic units 17R/17L are mounted to lower end portions of the right/left housing units 31R/31L. The right/left housing units 31R/31L are set in such a manner that these right/left housing units 31R/31L are movable along upper/lower directions (as viewed in FIG. 3) within a preselected range. Also, the heights of the right/left housing units 31R/31L, namely the heights of the right/left-channel acoustic units 17R/17L can be adjusted in such a way that when the headphone 10 is set on a head of a user, these right/left housing units 31R/31L are positioned opposite to right/left ears of the user. Also, this head band 32 is manufactured to have elastic characteristics along right/left directions (as viewed in FIG. 3) under such a condition that the right/left-channel acoustic units 17R/17L are made in contact with the right/left ears under certain pressure.

Then, the electronic circuits selected from the jack 11 to the amplifiers 16R/16L (see FIG. 2) are built in the left housing unit 31L, whereas the cell 21 and further the power supply switch 22 are built in the right housing unit 31R. In this case, as represented in FIG. 3, the jack 11 is provided outside the left housing unit 31L, and a connection cable 40 is connected to this jack 11.

This connection cable 40 is manufactured so that connector plugs 41 and 42 are connected to both ends of a coaxial cable 43. When this headphone 10 is used, the connection plug 41 is inserted into the jack 11, and another connector plug 42 is inserted into a digital audio output jack 52 of a CD player 50 as shown in FIG. 3, namely a digital audio output jack of a digital audio appliance.

With employment of such a structure, when the connector plugs 41 and 42 are inserted into the jacks 11 and 52 to set the CD player 50 to the reproduction mode, the digital audio signal SD is outputted to the jack 52. Then, this digital audio signal SD is supplied via the connection cable 40 to the jack 11.

As previously explained, the digital audio signal SD supplied to the jack 11 is processed as follows. The digital audio interface 12 separates digital audio data "DATA" from the digital audio signal SD supplied to this digital audio interface 12, and then outputs the separated digital audio data DATA, and further the flag "LRCK" and also the bit clock "BCK" of the outputted digital audio data DATA. Then, the digital audio data DATA, the flag LRCK, and the bit clock BCK are supplied from this digital audio interface 12 to the DSP 13. This DSP 13 performs various sorts of acoustic process operations with respect to this digital audio data DATA supplied thereto. Thereafter, the digital audio data DATA, the flag LRCK, and the bit clock BCK are supplied to the D/A converter 14, so that this digital audio data DATA is D/A-converted into the left-channel analog signal "L" and the right-channel analog signal "R". These right/left-channel signals R/L are filtered by low-pass filters 15R and 15L. Then, the filtered right/left-channel signals R/L are amplified by the right/left-channel amplifiers 16R/16L. The amplified right/left-channel signals are supplied to the right/left-channel acoustic units 17R/17L so as to be converted into the right/left-channel acoustic output signals. As a result the user can hear music and the like reproduced by the CD player 50 by employing the headphone 10 according to this embodiment.

In accordance with the above-described headphone 10, the audio signal derived from the CD player 50 is received under the condition of the digital audio signal SD, this digital audio signal SD is converted into the analog audio signals R/L within the headphone 10, and thereafter the acoustic units 17R/17L are driven in the above-described manner. As a result, it is possible to provide the high sound quality expected by the headphone designer, while having the low dependent degrees with respect to the sound quality of the CD player 50.

Otherwise, since the analog circuits for giving large influences to the sound qualities are provided in one-to-one correspondence with the acoustic units 17R/17L, the overall sound qualities can be determined by the headphone designer. In particular, since the sound quality can be compensated even by the DSP 13 and furthermore the sound quality can be precisely compensated, this headphone can provide better sound qualities.

Furthermore, even when the cable 40 is extended, substantially no adverse influence is given to the digital audio signal SD, so that the deterioration of the sound quality can be suppressed. Also, when a user uses a portable telephone very close to the conventional headphone, the electromagnetic waves of this portable telephone are transmitted to be entered via the headphone cable into the CD player 50, resulting in occurrences of interference noise. However, in accordance with the headphone 10 of this embodiment, even when such a noise signal as the transmitted electromagnetic waves is electromagnetically coupled to the connection cable 40, no adverse influence is given to the digital audio signal SD unless the level of this noise signal exceeds the threshold levels of "0" and "1" of this digital audio signal SD. In other words, the headphone 10 of this embodiment can be protected from the interference noise.

Also, in the conventional headphone, an audio signal may be received in an analog signal condition from a CD player and the like, and also an A/D converter, a DSP, and a D/A converter may be employed within this conventional headphone so as to compensate for the sound quality in the above-described manner. In such an alternative case, a total number of electronic components is increased due to the newly employed A/D converter. Furthermore, in this conventional headphone, the analog audio signals R/L which have been D/A-converted in the CD player are again A/D-converted. Then, after the digital audio signals are quality-processed, the resultant digital audio signals are again D/A-converted, which requires cumbersome/extra signal processing operations. Accordingly, the sound quality of the finally-processed audio signals would be deteriorated. To the contrary, since the headphone 10 according to this embodiment receives the audio signal in the form of the digital signal SD at the first stage, such a problem never occurs.

Figure 4:
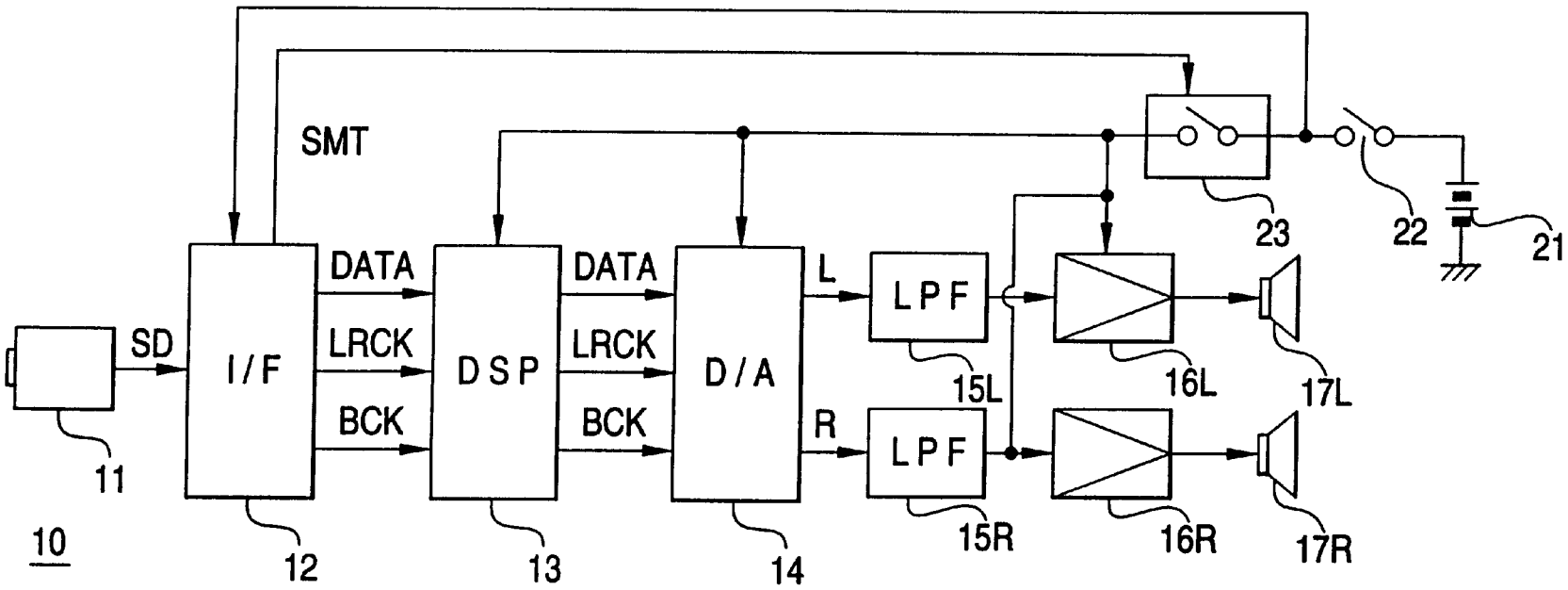
FIG. 4 is a schematic block diagram for representing an internal circuit of a headphone according to another embodiment of the present invention.

FIG. 4 is a schematic block diagram for showing a circuit diagram of a headphone according to another embodiment of the present invention. It should be understood that the same reference numerals shown in FIG. 2 will be employed as those for indicating the same, or similar circuits of FIG. 4, and detailed descriptions thereof are omitted. Also, since an outer view of this headphone shown in FIG. 4 is similar to that indicated in FIG. 3, this outer view is omitted.

The headphone 10 shown in FIG. 4 is designed to reduce power consumption in such a manner that the operation mode of this headphone is set to a standby mode. In other words, a voltage of a cell 21 is applied as an operation voltage via a power supply switch 22 to a digital audio interface 12, and also is supplied as operation voltages via a switch circuit 23 to various circuits 13, 14, 16R and 16L.

In the case that the digital audio interface 12 is realized as an IC (integrated circuit), since a muting control signal SMT can be obtained from this digital audio interface 12, this muting control signal SMT is supplied as a control signal to the switch circuit 23. When the level of the muting control signal SMT is capable of turning ON the muting operation, the switch circuit 23 is turned OFF, whereas when the level of this muting signal is capable of turning OFF the muting operation, the switch circuit 23 is turned ON.

With employment of this circuit arrangement, while the digital audio signal SD is received, the switch circuit 23 is turned ON in response to the muting control signal SMT, so that the voltage of the cell 21 is applied via this switch circuit 23 to the DSP 13, the D/A converter 14, and the right/left-channel amplifiers 16R/16L. As a result, as previously explained, this headphone 10 may be operated as an active headphone.

However, in the standby mode, since the headphone is brought into the no signal state, the switch circuit 23 is turned OFF in response to the muting control signal SMT, so that the voltage of the cell 21 is not applied to the DSP 13, the D/A converter 14, and the right/left-channel amplifiers 16R/16L. As a result, the power consumption of the cell 21 can be reduced during the standby mode of this headphone. At this time, since the muting control signal SMT is produced in response to the digital audio signal SD in order to turn ON/OFF the muting operation, the switch circuit 23 can be firmly and correctly turned ON/OFF.

As previously explained, the connection cable 40 is the coaxial cable. Alternatively, an optical cable may be employed as this connection cable 40. In this alternative case, the connector 11 may be realized as a light receiving optical connector. With employment of such an optical cable, since the headphone 10 can be electrically separated from the CD player 50, this headphone 10 can have a further merit in view of noise.

Alternatively, in the case that a digital filter is provided between the DSP 13 and the D/A converter 14 so as to over-sample the digital audio data DATA, the right/left-channel low-pass filters 15R and 15L may be made simple, resulting in a compact headphone and a low-cost headphone. Furthermore, the interface circuit 12, the DSP 13, the D/A converter 14, the low-pass filters 15R/15L, the right/left-channel amplifiers 16R/16L, the switch 22, and the switch circuit 23 may be provided within the housings of the right/left-channel acoustic units 17R/17L.

In accordance with the headphone of the present invention, it is possible to provide the high sound quality expected by the headphone designer, while having the low dependent degrees with respect to the sound quality of the digital audio signal source. Also, when the DSP is employed, since the sound quality can be compensated by this DSP and also the sound quality can be more precisely compensated by this DSP, the headphone of the present invention may provide better sound qualities.

Furthermore, even when the connection cable is extended, the deterioration of the sound quality can be suppressed, and also the headphone can be protected from the interference noise. Also, the total number of electronic components employed in the headphone is not increased and the sound quality is not deteriorated, as compared with such a case that the headphone receives the audio signal in the analog signal form from the digital audio appliance, and the A/D converter, the DSP, and the D/A converter are provided within the headphone so as to compensate the sound quality. Moreover, the power consumption of the headphone during the standby mode can be reduced.

What is claimed is:

1. A headphone comprising:

a jack to which a digital audio signal derived from a digital audio appliance is supplied, wherein the digital audio signal is a serial signal including left and right audio channels;

a digital signal processor for performing an acoustic sound process with respect to the digital audio signal fed into said jack;

a digital-to-analog converter for converting and separating said digital audio signal supplied from said digital signal processor into an analog left-channel audio signal and an analog right-channel audio signal;

amplifier means for amplifying said analog left-channel audio signal and said analog right-channel audio signal derived from said digital-to-analog converter; and acoustic means for receiving and converting the amplified analog left-channel audio signal and the amplified analog right-channel audio signal from the amplifier means and for converting the analog audio signals into acoustic sounds, wherein said acoustic means, said jack, said digital signal processor, said digital-to-analog converter, and said amplifier means are built into said headphone.

2. The headphone as set forth in claim 1, further comprising a cell functioning as an operating power supply for said acoustic means, wherein said cell is built into said headphone.

3. The headphone as set forth in claim 2, wherein said digital audio signal is selected from a digital input/output format standardized by Electronic Industries Association of Japan.

4. A headphone comprising:

a connector unit to which a digital audio signal derived from a digital audio appliance is supplied, wherein said digital audio signal is selected from a digital input/output format standardized by Electronic Industries Association of Japan;

a digital-to-analog converter for converting said digital audio signal supplied to said connector unit into an analog audio signal;

an amplifier for amplifying said analog audio signal derived from said digital-to-analog converter;

an acoustic unit for receiving the amplified analog audio signal from the amplifier and for converting the analog audio signal into an acoustic sound, wherein said acoustic unit, said connecter unit, said digital-to-analog converter, and said amplifier are built into said headphone;

a cell functioning as an operating power supply for said acoustic unit, said digital-to-analog converter, and said amplifier is built into said headphone;

a digital signal processor for performing an acoustic sound process with respect to the digital audio signal, said digital signal processor being built into said headphone; and control means for detecting whether said digital audio signal is present and for ON/OFF-controlling an operation voltage applied to said digital-to-analog converter, said amplifier, and said digital signal processor.

* * * * *